United States Patent [19]

Virgo

[11] Patent Number: 5,076,799

[45] Date of Patent: Dec. 31, 1991

[54] COAXIAL CABLE CONNECTOR

[75] Inventor: Roger Virgo, Felpham, England

[73] Assignee: Futters (London) Limited, London, England

[21] Appl. No.: 610,061

[22] Filed: Nov. 7, 1990

[30] Foreign Application Priority Data

Jul. 23, 1990 [GB] United Kingdom ..... 90116137

[51] Int. Cl.[5] ..... H01R 4/24

[52] U.S. Cl. ..... 439/394; 439/582

[58] Field of Search ..... 439/578–585, 439/731, 607, 394–397, 63, 225

[56] References Cited

U.S. PATENT DOCUMENTS

| | | | |
|---|---|---|---|
| 2,805,399 | 9/1957 | Leeper | 439/582 |
| 3,461,419 | 8/1969 | Link | 439/394 |
| 4,437,722 | 3/1984 | Bianchi | 439/394 |
| 4,708,414 | 11/1987 | Lam | 439/582 |
| 4,746,307 | 5/1988 | Joly et al. | 439/394 |

FOREIGN PATENT DOCUMENTS

| | | | |
|---|---|---|---|
| 0077210 | 4/1983 | European Pat. Off. | 439/581 |
| 0081953B | 6/1983 | European Pat. Off. . | |
| 0109229 | 5/1984 | European Pat. Off. | 439/394 |
| 0038144B | 6/1985 | European Pat. Off. . | |
| 109229B | 4/1986 | European Pat. Off. . | |
| 0246741A | 11/1987 | European Pat. Off. . | |
| 0311226A | 4/1989 | European Pat. Off. . | |
| 1-22577 | 5/1989 | Japan | 439/394 |
| 2082850B | 3/1982 | United Kingdom . | |
| 2156170B | 10/1985 | United Kingdom . | |

*Primary Examiner*—David L. Pirlot

*Attorney, Agent, or Firm*—Nixon & Vanderhye

[57] ABSTRACT

A connector for tapping a coaxial cable has a housing (2) formed of two generally identical housing parts made of a plastics material. A longitudinal bore (4) extending through the housing (2) receives a cable to be tapped. Facing surfaces of the housing parts are arranged to abut and each has a generally U-shaped channel (14) therein which defines the bore (4) upon abutment. The housing parts also form a further bore (16) which extends transversely to, and communicates with, the first bore. An elongate probe (20) to contact the core of the coaxial cable is received within the transverse bore (16). Two contacts (32), for contacting outer conductors of the cable, are held in the first bore, one on either side of the transverse bore. Because the housing parts completely define the two bores it is ensured that reliable connections to the coaxial cable are always made.

15 Claims, 3 Drawing Sheets

COAXIAL CABLE CONNECTOR

BACKGROUND OF THE INVENTION

The present invention relates to a coaxial cable connector.

Coaxial cable connectors arranged to tap a coaxial cable are well known. The most commonly used such connector has a body along a surface of which a channel extends for receiving the cable. Metal contacts having one or more upstanding prongs are seated in the channel and have elongate contact posts which extend through the body to the exterior. A bore extends through the body and communicates with the channel. In use, the coaxial cable is received in the channel and a clamping assembly is then slid on to the body. This clamping assembly comprises a channel member arranged to be slid on to the body and in which channel member a pressure block is held. A screw in the channel member can be tightened to apply the pressure block down on to the coaxial cable such that it is pushed into the channel and into contact with the prongs of the contacts. The prongs thereby pierce the outer insulation of the coaxial cable and come into contact with the outer conductive braiding. With the cable held captive between the body and the pressure block, a drilling tool is inserted through the bore into the body to make a hole in the cable through to its central core. The tool is then removed and a "beesting" connector in the form of an insulated probe is inserted in the bore to make contact with the core of the cable.

Such coaxial cable connectors are in widespread use and are generally satisfactory. However, there can be difficulties in ensuring good connection of the prongs of the contacts with the braiding of the cable because of a tendency for the pressure applied by the cable to the prongs to deform them rather than push them to pierce the cable. In addition, the amount of pressure applied to the cable by way of the pressure block is variable and this means that the exact location of the core of the cable in its channel is not predetermined. Because of this, the insulated probe may not be reliably connected to the core of the cable.

SUMMARY OF THE PRESENT INVENTION

It is an object of the present invention to provide a coaxial cable connector in which the disadvantages of the known connector are reduced.

According to a first aspect of the present invention there is provided a coaxial cable connector comprising two housing parts arranged to form a housing, each said housing part having a first elongate channel therein arranged such that the first elongate channels of the two housing parts together define a first bore extending substantially longitudinally through said housing for receiving a coaxial cable, and each said housing part having a further channel therein extending substantially transversely to its first channel, said further channels of the two housing parts being arranged to together define a second bore in said housing extending substantially transversely to, and communicating with, the first bore, and wherein said connector further comprises an elongate probe for making contact with the core of a coaxial cable received in said first bore, said probe being arranged to extend in said second, transversely extending bore, and at least one contact received in said first bore for contacting the outer conductor of a coaxial cable received in said first bore.

With a connector of the invention, the two housing parts completely define both the first and the second bores so that their relative positioning in the housing is determined in advance and is invariable. This in its turn means that the position of a cable received in said first bore is always known such that reliable connections can be made thereto.

Preferably, interengaging means are provided to maintain the two housing parts in abutment and/or in engagement. Said interengaging means may comprise locating means on the two housing parts to facilitate their reliable interengagement. Additionally and/or alternatively, screws and/or externally applied clamping means may be provided as the interengaging means. Additionally and/or alternatively, the interengaging means may comprise projections on one of the housing parts arranged to be received in corresponding recesses on the other of the housing parts whereby the interengaging means both positively locate the housing parts relative to one another and hold them in position.

Preferably, the two housing parts are made of non-conductive material, for example, the two housing parts may be injection moulded from plastics material. Generally, the two housing parts have substantially the same external configuration and dimensions.

The first bore which extends substantially longitudinally through the housing is preferably formed from a generally U-shaped channel in each of said housing parts whereby a substantially cylindrical bore through said housing is defined. In an embodiment, the surface of at least one of said channels is formed with one or more flats and at least one said contact is mounted on each said flat. For example, each of said contacts may be secured in one of the housing parts.

Screw means may extend through each said contact, the screw means being utilised to secure one housing part to the other housing part.

The fact that each said contact is mounted on a flat is advantageous as this limits the risk of deformation of the contact.

Preferably, each said contact comprises one or more projecting prongs of electrically conductive material. The contact is mounted in the or each housing part such that the prongs project into said first bore. In an embodiment the prongs project substantially perpendicularly to the longitudinal extent of the first bore.

In an embodiment each said contact comprises a plate of conductive material out of which a plurality of projecting prongs are stamped. In one embodiment, two pairs of prongs spaced relative to one another longitudinally of said first bore are provided on each said contact plate. In addition, each said contact is extended by an elongate conductive contact post connected to said plate and extending exteriorly of the housing. Preferably, each said elongate contact post extends between the two housing parts or within a passageway defined by the said two housing parts.

In a preferred embodiment, two said contacts are arranged in said first bore, one on either side of said second transversely extending bore.

In an embodiment, said elongate probe comprises a non-conductive probe body surrounding an elongate conductive probe which projects from each end of the probe body. Preferably, the probe body is provided with an external thread arranged to engage with an internal thread provided in said second bore.

In a preferred embodiment one or two covers of non-conductive material are provided and are arranged to clip on to the connector.

In use, the two housing parts are arranged on either side of a length of coaxial cable and are then engaged together such that the coaxial cable extends through the housing in said first bore. As the two housing parts are engaged, they clamp the cable into position and the prongs of the contacts pierce the outer insulation of the cable and come into contact with the outer conductor. Electrical connections can then be made to the outer conductor by way of the elongate contact posts which extend to the exterior of the housing.

With the housing firmly engaged around the coaxial cable, a drilling tool may be inserted through said second bore such that a hole can be drilled in the coaxial cable to its central core. The drilling tool is then removed and the elongate probe positioned in the second bore such that the elongate probe is in electrical contact with the core of the cable.

A tool may be provided to facilitate the positioning of the probe. For example, the tool may comprise a handle with a number of interchangeable heads, one or more of the heads being drilling tools. The tool is preferably also provided with a socket which is arranged to hold the probe body as the probe is positioned in place.

The present invention also extends to a method of tapping a coaxial cable using a connector as defined above.

According to a further aspect of the present invention there is provided a method of tapping a coaxial cable comprising clamping the cable between two housing parts of a connector such that the cable extends within a first longitudinal bore defined by the two housing parts, inserting a drilling tool in a second bore defined by said two housing parts and drilling a hole in the cable, and removing the drilling tool and inserting a probe into said second bore such that said probe is in contact with the cable.

BRIEF DESCRIPTION OF THE DRAWINGS

Embodiments of the present invention will hereinafter be described, by way of example, with reference to the accompanying drawings, in which.

DESCRIPTION OF PREFERRED EMBODIMENTS

Figure 1:
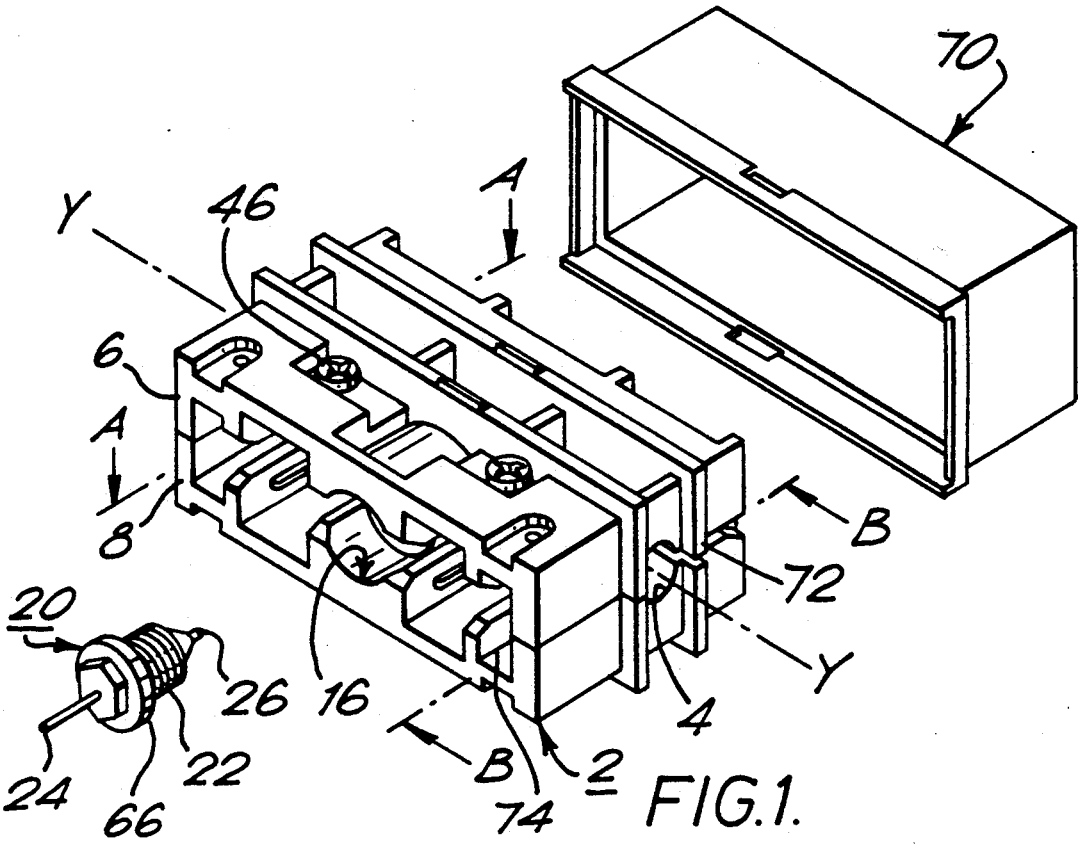
FIG. 1 shows a perspective view of a coaxial cable connector of the invention.

FIG. 1 shows a connector for use when it is required to tap a coaxial cable. The connector has a housing 2 made of a non-conductive material, such as plastics material, through which a substantially longitudinally extending bore 4 extends. A coaxial cable (not shown) which is to be tapped is arranged to extend through the bore 4. The axis of the bore 4 and of the coaxial cable when present is indicated by Y—Y.

As is apparent, the housing 2 is formed of two housing parts 6 and 8 which are generally identical in their external configuration and dimension. These two housing parts 6 and 8 are arranged to be abutted and to be maintained in this position to define the bore 4 and to clamp the cable in the bore 4. Each of the housing parts 6 and 8 is a substantially cuboid body formed, for example, by injection moulding out of plastics material. Along the facing surfaces thereof, each of the housing parts 6 and 8 is provided with a substantially longitudinally extending, generally U-shaped channel 14. It will be appreciated therefore that when the facing surfaces of the two housing parts 6 and 8 are abutted as illustrated, the two channels 14 together define the bore 4. Preferably, the two channels 14 are substantially semi-circular in cross-section so that the bore 4 is substantially circular cylindrical in cross-section.

Figure 2:
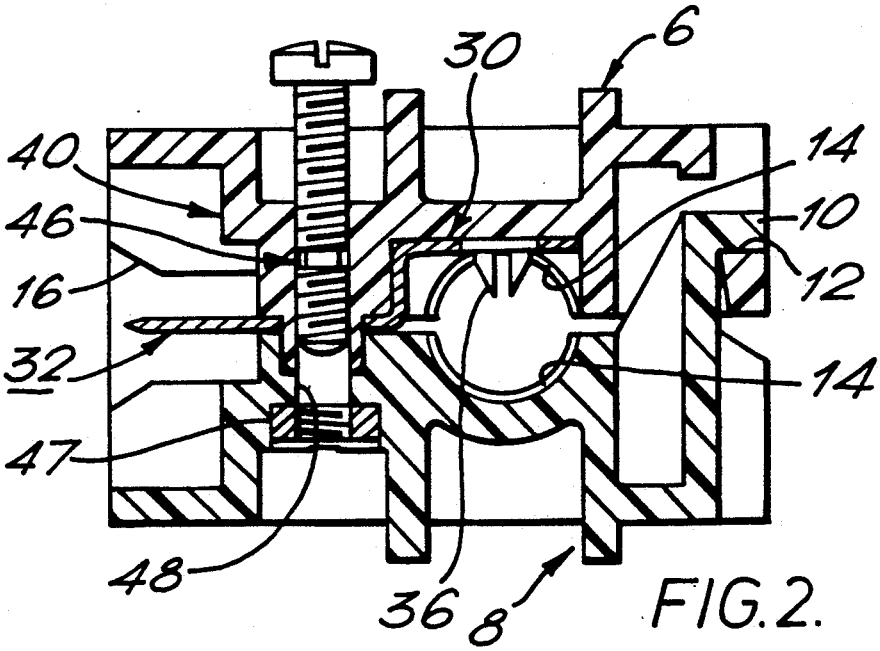
FIG. 2 shows a section taken along the line A—A of the connector of FIG. 1.

As is most clearly seen in FIG. 2, along one of its longitudinally extending sides, the housing part 8 is provided with a series of spaced, hooked projections 10. In the abutted position of the two housing parts 6 and 8, these projections 10 are arranged to engage within cutouts 12 provided along the adjacent longitudinally extending side of the housing part 6. The projections 10 and cutouts 12 thereby form interengaging means providing position location of the two housing parts 6 and 8 relative to each other, but also serving to maintain the two housing parts interengaged.

The facing abutting surfaces of the two housing parts 6 and 8 are also each provided with a further substantially semi-circular cross-sectional channel which extends generally transversely to, and opens into, the channel 14. Accordingly, in the abutted position of the two housing parts which is shown in FIG. 1, the two further channels together form a further substantially circular cylindrical bore 16 which extends substantially transversely to, and communicates with, the first longitudinally extending bore 4. As indicated in FIG. 1, an elongate probe 20 for making contact with the core of the coaxial cable is arranged to be received within the transversely extending bore 16. The probe 20 has a probe body 22 of a non-conductive material, for example of a plastics material, which, as can be seen in FIG. 1, is provided with an external screw thread. In this respect, the surface of the second bore 16 is provided with a corresponding internal screw thread. An elongate conductive probe 24 having a pointed tip 26 extends through the probe body 22 such that the tip 26 projects beyond the body 22. As we shall see, when the probe 20 is in position in the connector, its tip 26 makes contact with the central core of the coaxial cable.

Figure 3:
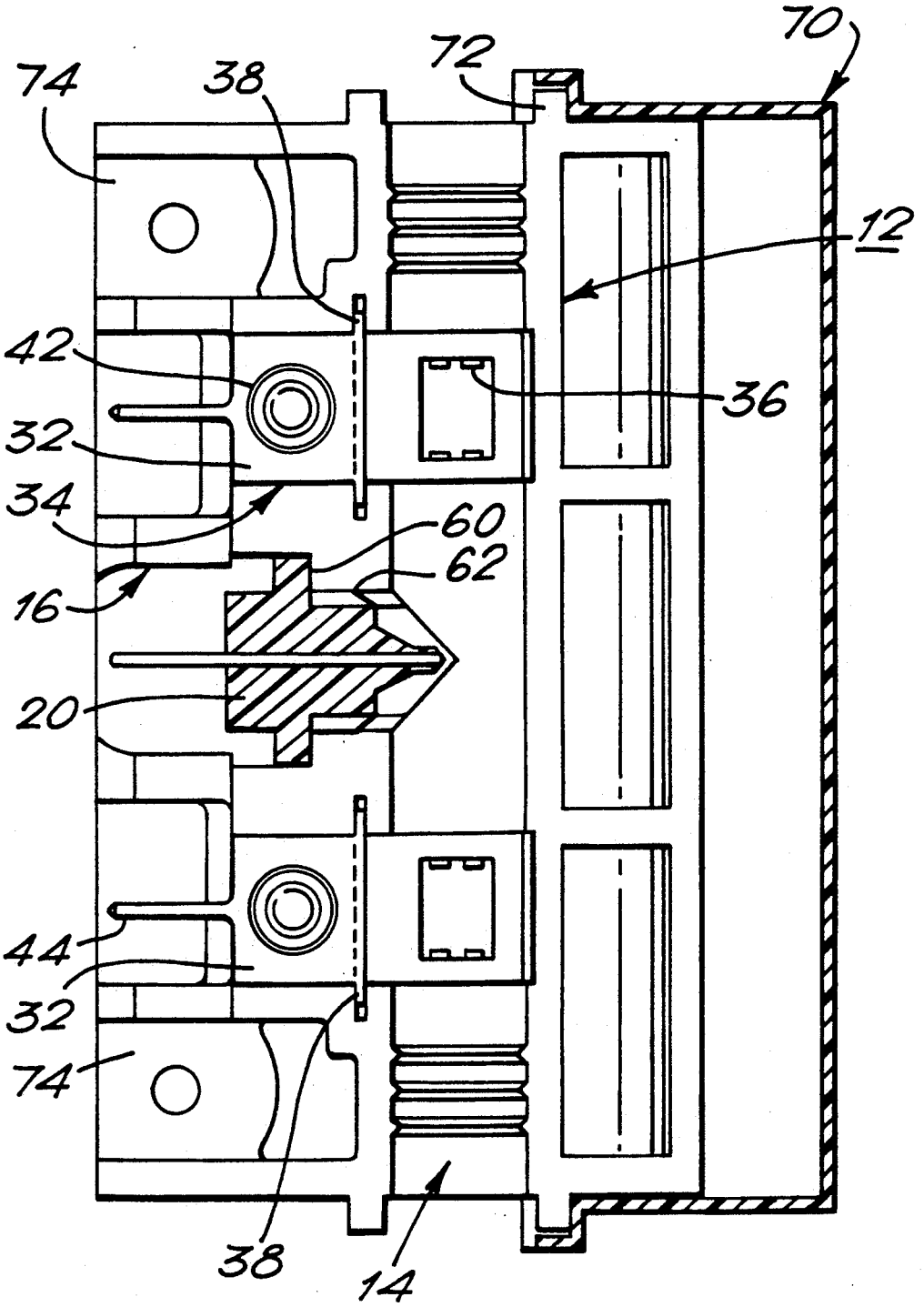
FIG. 3 is a longitudinal section taken along the line B—B of the connector of FIG. 1, but with a cover in place.

At two longitudinally spaced locations, the longitudinal channel 14 of the upper housing part 6 is provided with a flattened surface or flat as indicated at 30. A contact generally indicated 32 is mounted in the upper housing part 6 on the flat 30. As shown in FIG. 3, the contact 32 comprises a plate 34 of a conductive material, preferably of a metal. Two pairs of prongs 36 projecting into the bore 4 are stamped out of each said plate 34. The prongs 36 of one pair are arranged adjacent to each other and are longitudinally spaced from the prongs 36 of the other pair.

The contact 32 is also formed to have integral locating tongues 38 arranged to engage in corresponding grooves (not shown) provided in the upper housing part 6. In this manner, the contact 32 is held in the housing part and is held on the flat 30. It will be seen from FIG. 2 that the contact plate 34 of the contact 32 is bent about two substantially parallel, longitudinally extending axes so that the area of the contact plate 34 from which the prongs depend is substantially parallel to, but spaced from, a further area of the contact plate 34 in which a screw hole 42 is provided. The tongues 38 are conveniently extensions of the contact plate 34 at one or both of the bends therein. The contact 32 is also provided with an extended elongate contact post 44 which extends from the contact plate 34 exteriorly of the housing 2 in a passageway therefor which is defined between the two housing parts 6 and 8. As can be seen, the contact post 44 extends generally transversely to the longitudinal extent of the housing 2.

In use of the connector shown in FIGS. 1 to 3, the two housing parts 6 and 8 are arranged on either side of a length of coaxial cable (not shown) and are engaged by way of the interengaging means 10, 12 so that their facing surfaces are brought towards one another. Screws 46 extend in bored screw posts 40 formed in the upper housing part 6. In the engaged position of the two housing parts 6 and 8, the screw posts 40 are aligned with corresponding bores 48 in the lower housing part 8, and the screws 46 engage with respective nuts 47 trapped in the bores 48. Accordingly, by screwing the screws 46 through the posts 40 into the corresponding bores 48, the two housing parts 7 and 8 are drawn together so that their facing surfaces abut. The screws 46, together with the interengaging means 10, 12 maintain the two housing parts 6, 8 in abutment in which position the coaxial cable is clamped in the bore 4.

It will be appreciated that the hole 42 in each contact plate 34 of each contact 32 is also aligned with a respective bored screw post 40. Thus, the screws 46 each extend through a respective contact plate 34 in the abutment position of the housing parts 6, 8 thereby retaining the contacts 32 positively in position. It is important to positively retain the contacts 32 because, as the two housing parts 6 and 8 are drawn together by screwing the screws 46, the prongs 36 of the contacts 32 pierce the outer insulation of the coaxial cable and thereby come into electrical contact with the outer conductor thereof. This outer conductor is generally in the form of metal braiding. In this respect, because the area of the contact plate 34 from which the prongs 36 depend is generally planar and is held against a flat surface 30, reliable penetration of the cable by the prongs 36 is assured. Furthermore, there is no risk of deformation of the prongs 36 by the curvature of the channel 14.

Figure 4:
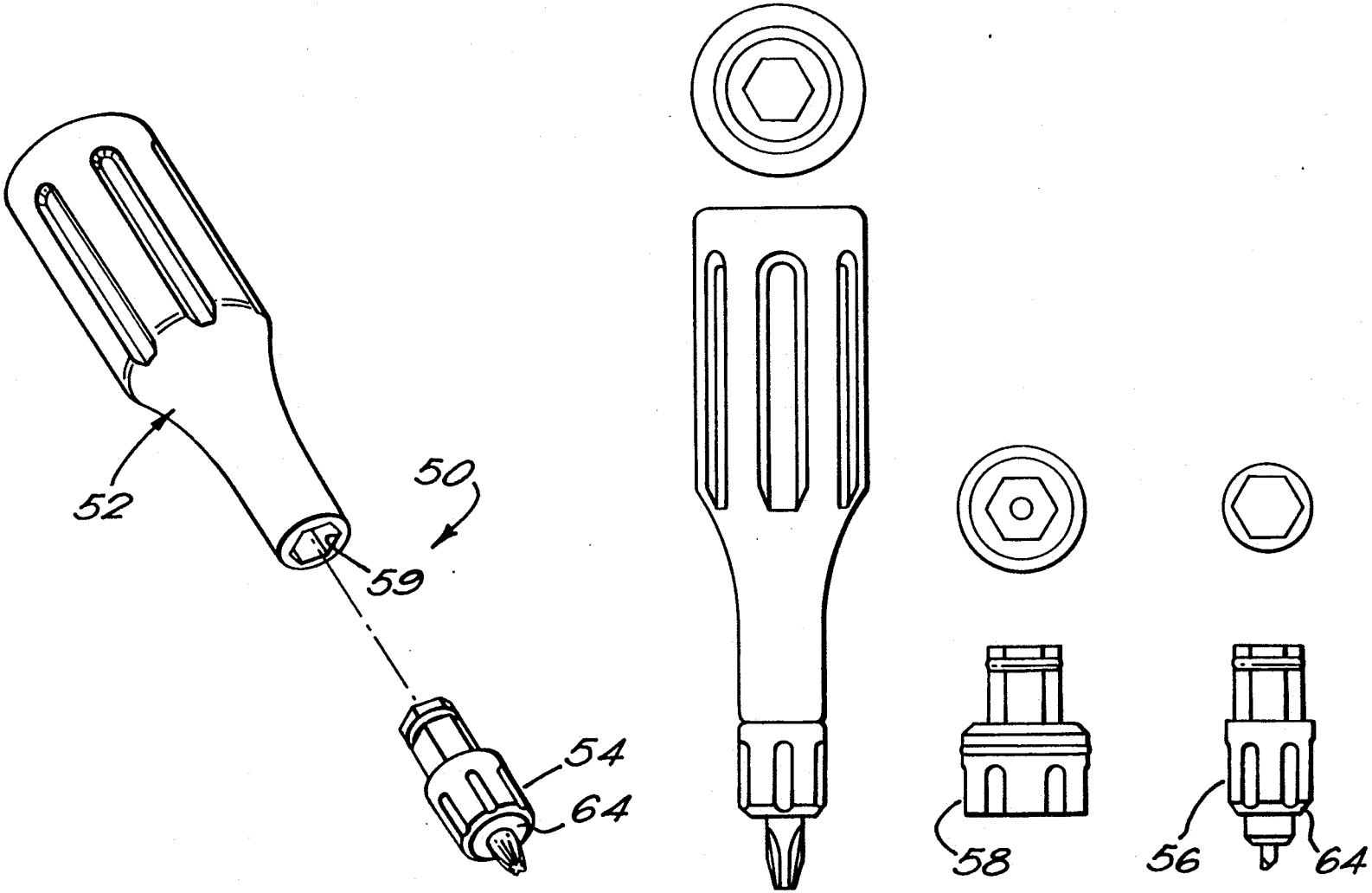
FIG. 4 shows an exploded perspective view of a tool for use with the connector together with elevational views of alternative heads for the tool.

Once the two housing parts 6 and 8 have been secured in their abutment position, the coaxial cable is reliably clamped therein. A hole can then be drilled into the cable to enable the probe 20 to contact the cable's central core. In this respect, FIG. 4 shows a tool generally indicated at 50 which is provided with a handle 52. It will be seen that the handle 52 has an internal socket 59 in which a number of alternative replaceable heads 54, 56 and 58 can be engaged. The heads 54 and 56 are each drill heads and can be used in succession to bore a hole through the outer insulation, the outer conductor, and the inner insulation of the coaxial cable. In this respect, the tool 50 fitted with the appropriate head is inserted into the transverse bore 16 of the housing 2 so that a drill bit carried by the drill head contacts the coaxial cable. Rotation of the drill head, which may be manually, mechanically or powered, thereby drills a hole penetrating into the coaxial cable.

In this respect, and as can be seen on FIG. 3, the bore 16 is shaped to define a shoulder 60 and then to have a circular cylindrical portion 62 carrying an internal screw thread. Each of the drill heads 54 and 56 is provided with a shoulder 64 which is arranged to abut against the shoulder 60 of the bore 16 and thereby control the penetration of the head into the bore 16 and hence into the cable.

Once the appropriate hole has been bored, the socket 59 formed in the handle 52 is engaged with the outer end of the probe 20 so that the probe 20 can be advanced into the bore 16 by use of the tool 50 and then engaged by screw threading into the threaded bore portion 62. In the fully engaged position, a shoulder 66 formed on the probe body 22 abuts the shoulder 60 of the bore 16 whereby the penetration of the probe 20 into the bore 16 is determined. In this position, the tip 26 of the probe 20 is in contact with the central core of the coaxial cable.

The socket head 58 provided for the handle 52 has a socket therein of a different size to the socket 59. The socket head 58 is therefore arranged to adapt the handle 52 for use with different size probes and the like.

It will be appreciated that because the relative position of the transverse bore 16 and the longitudinally extending bore 4 in the housing 2 are fixed the exact depth of the hole to be drilled into the cable is known. Furthermore, the shoulder 60 of the bore 16 acts to control the penetration of the drilling tool and subsequently of the probe 20 to an appropriate extent.

It will be appreciated that the connector shown in the drawings is particularly simple in its construction and is therefore relatively inexpensive and easy to manufacture.

It may be required to provide a cover as 70 to clip over the connector when it has been positioned on a cable, for example for appearance as a dust cover, and/or to prevent access to the screws 46. The cover 70 shown in FIGS. 1 and 3 is arranged to receive part of both of the housing parts 6 and 8 and engages with a rib 72 formed to extend around the two housing parts. It will also be seen that the cover 70 is engageable over the opposite end of the connector if required. Thus, the cover 70 can be used to protect the probe 24 and the contact posts 44, for example, before the connector is connected to other circuit elements.

The contact posts 44 of the contacts 32 and the elongate conductive probe 24 of the probe 20 are, in use, electrically connected to elements of an electrical circuit as required. These elements or connectors therefore can be received in the passageways defined by the housing parts containing the contact posts 44 and/or in the bore 16. It may be required to support the connector relative to additional circuit elements and in this respect it will be seen that the two housing parts 6 and 8 are arranged to define longitudinally spaced recesses 74 which are also provided with screw holes. Connecting tabs, for example of printed circuit boards or the like may therefore be engaged in the recesses 74 and suitably secured.

In the illustrated embodiment, the two housing parts 6, 8 are formed with interengaging means 10, 12. However, it will be appreciated that these means could be omitted to simplify the construction of the housing parts and the housing parts held in abutment by screws and/or by external clamping means.

As illustrated, although the housing parts 6, 8 have substantially the same external configuration and dimensions, they do have differing cross-sectional shapes. It would be possible, if required, for the two housing parts to be identical.

It will be appreciated that modifications and variations to the construction as described and illustrated may be made within the scope of this application.

I claim:

1. A coaxial cable connector comprising a housing having a longitudinal and a transverse extent, first and second housing parts being provided and being arranged to form said housing, a first generally U-shaped elongate channel arranged in each said housing part, said first elongate channels of the two housing parts together defining a first substantially cylindrical bore extending substantially longitudinally through said housing for receiving a coaxial cable, and a further channel in each said housing part, each said further channel extending substantially transversely to the first channel of the said housing part, wherein said further channels of the two housing parts are arranged to together define a second bore in said housing extending substantially transversely to, and communicating with, said first bore, and wherein said connector further comprises an elongate probe for making contact with the core of a coaxial cable received in said first bore, said probe being arranged to extend in said second, transversely extending bore, and at least one contact received in said first bore for contacting the outer conductor of a coaxial cable received in said first bore, said connector further comprising one or more flats on the surface of at least one of said channels, at least one said contact mounted on each said flat, and screw means extending through each said contact, said screw means being utilized to secure said first and second housing parts together.

2. A coaxial cable connector according to claim 1, wherein, each said contact comprises one or more projecting prongs of electrically conductive material, each said contact being mounted in the or each said housing part such that the prongs project into said first bore, wherein said prongs project substantially perpendicularly to the longitudinal extent of the first bore.

3. A coaxial cable connector according to claim 2, wherein each said contact comprises a plate of conductive material out of which a plurality of projecting prongs are stamped.

4. A coaxial cable connector according to claim 1, further comprising one or two covers of non-conductive material, the or each said cover being arranged to clip onto the conductor.

5. A coaxial cable connector according to claim 1, further comprising projections on the first said housing part and recesses on said second housing, said projections being arranged to be received in corresponding recesses to positively locate the housing parts relative to one another and to hold them in position.

6. A coaxial cable connector according to claim 1, wherein said first and second housing parts are made of non-conductive material, and wherein said first and second housing parts have substantially the same external configurations and dimensions.

7. A coaxial cable connector according to claim 1, wherein said elongate probe comprises a non-conductive probe which projects from each end of the probe.

8. A coaxial cable connector according to claim 7, wherein an external thread is provided on said probe body, and an internal thread, with which said external thread is arranged to engage, is provided in said second bore.

9. A coaxial cable connector comprising a housing having a longitudinal and a traverse extent, first and second housing parts being provided and being arranged to form said housing, a first generally U-shaped elongate channel arranged in each said housing part, said first elongate channels of the two housing parts together defining a first substantially cylindrical bore extending substantially longitudinally through said housing for receiving a coaxial cable, and a further channel in each said housing part, each said further channel extending substantially transversely of the first channel of the said housing part, wherein said further channels of the two housing parts are arranged to together define a second bore in said housing extending substantially transversely to, and communicating with, said first bore, and wherein said connector further comprises an elongate probe for making contact with the core of a coaxial cable received in said first bore, said probe being arranged to extend in said second, transversely extending bore, and at least one contact received in said first bore for contacting the outer conductor of a coaxial cable received in said first bore, said connector further comprising one or more flats on the surface of at least one of said channels, at least one said contact mounted on each said flat, wherein each said contact comprises a plate of conductive material out of which a plurality of projecting prongs are stamped, each said contact plate being mounted in the or each said housing part such that the prongs project into said first bore, wherein said prongs project substantially perpendicularly to the longitudinal extent of the first bore and two pairs of prongs are spaced relative to one another longitudinally of said first bore on each said contact plate, and an elongate conductive contact post is connected to said contact plate and extends exteriorly of the housing.

10. A coaxial cable connector according to claim 9, wherein each said elongate contact post extends between the first and second housing parts or within a passageway defined by the said first and second housing parts.

11. A coaxial cable connector according to claim 9, further comprising one or two covers of non-conductive material, the or each said cover being arranged to clip onto the conductor.

12. A coaxial cable connector according to claim 9, further comprising projections on the first said housing part and recesses on said second housing, said projections being arranged to be received in corresponding recesses to positively locate the housing parts relative to one another and to hold them in position.

13. A coaxial cable connector according to claim 9, wherein said first and second housing parts are made of non-conductive material, and wherein said first and second housing parts have substantially the same external configurations and dimensions.

14. A coaxial cable connector according to claim 9, wherein said elongate probe comprises a non-conductive probe which projects from each end of the probe.

15. A coaxial cable connector according to claim 14, wherein an external thread is provided on said probe body, and an internal thread, with which said external thread is arranged to engage, is provided in said second bore.

* * * * *

UNITED STATES PATENT AND TRADEMARK OFFICE

CERTIFICATE OF CORRECTION

PATENT NO. : 5,076,799

DATED : December 31, 1991

INVENTOR(S) : Roger VIRGO

It is certified that error appears in the above-identified patent and that said Letters Patent is hereby corrected as shown below:

ON THE TITLE PAGE

Item [30] second line, "90116137" should read --9016137.3--.

Signed and Sealed this

Twenty-first Day of September, 1993

Bruce Lehman

*Attest:*

BRUCE LEHMAN

*Attesting Officer*

*Commissioner of Patents and Trademarks*